US011821704B2

(12) United States Patent
Eggert

(10) Patent No.: US 11,821,704 B2
(45) Date of Patent: Nov. 21, 2023

(54) WEAPON SYSTEM AND BREECHBLOCK

(71) Applicant: Rheinmetall Waffe Munition GmbH, Suedheide (DE)

(72) Inventor: Klaus-Peter Eggert, Zimmern (DE)

(73) Assignee: RHEINMETALL WAFFE MUNITION GMBH, Suedheide (DE)

( * ) Notice: Subject to any disclaimer, the term of this patent is extended or adjusted under 35 U.S.C. 154(b) by 0 days.

(21) Appl. No.: 17/582,857

(22) Filed: Jan. 24, 2022

(65) Prior Publication Data

US 2022/0146222 A1 May 12, 2022

Related U.S. Application Data

(63) Continuation of application No. PCT/EP2020/069278, filed on Jul. 8, 2020.

(30) Foreign Application Priority Data

Jul. 25, 2019 (DE) ..... 10 2019 120 183.7

(51) Int. Cl.

| | |
|---|---|
| ***F41A 5/32*** | (2006.01) |
| ***F41A 3/26*** | (2006.01) |
| ***F41A 7/08*** | (2006.01) |
| ***F41A 15/14*** | (2006.01) |
| ***F41A 5/14*** | (2006.01) |

(52) U.S. Cl.
CPC ..... *F41A 5/32* (2013.01); *F41A 3/26* (2013.01); *F41A 5/14* (2013.01); *F41A 7/08* (2013.01)

(58) Field of Classification Search
CPC ..... F41A 3/26; F41A 5/32
USPC ..... 89/180, 181, 187.01
See application file for complete search history.

(56) References Cited

U.S. PATENT DOCUMENTS

| | | | | |
|---|---|---|---|---|
| 4,807,513 | A * | 2/1989 | Post | F41A 3/50 89/187.01 |
| 5,134,922 | A * | 8/1992 | Menges | F41A 7/08 89/11 |
| 8,616,112 | B2 | 12/2013 | Herrmann et al. | |
| 8,677,883 | B2 | 3/2014 | Woessner et al. | |
| 10,107,577 | B2 | 10/2018 | Kuhnle et al. | |
| 10,591,241 | B2 | 3/2020 | Schneider | |

(Continued)

FOREIGN PATENT DOCUMENTS

| | | |
|---|---|---|
| DE | 409091 C | 2/1925 |
| DE | 3712905 A1 | 11/1988 |

(Continued)

OTHER PUBLICATIONS

International Search Report dated Oct. 23, 2020 in corresponding application PCT/EP2020/069278.

*Primary Examiner* — Bret Hayes
(74) *Attorney, Agent, or Firm* — Muncy, Geissler, Olds & Lowe, P.C.

(57) ABSTRACT

A weapon system having a breechblock, wherein the breechblock can be mechanically connected to a drive of the weapon system. The weapon system comprises means which are designed in such a way that a mechanical separation occurs between the breechblock and the breechblock drive with the recoil of the recoiling masses of the weapon system. With the forward motion of the recoiling masses, the mechanical connection between the breechblock drive and the breechblock is re-formed.

17 Claims, 2 Drawing Sheets

(56) References Cited

U.S. PATENT DOCUMENTS

| | | | |
|---|---|---|---|
| 10,739,102 | B2 | 8/2020 | Schneider |
| 2005/0011346 | A1 | 1/2005 | Wolff et al. |

FOREIGN PATENT DOCUMENTS

| | | | | | |
|---|---|---|---|---|---|
| DE | 102006022622 | A1 | | 11/2007 | |
| DE | 102007048468 | A1 | | 4/2009 | |
| DE | 102008060217 | A1 | | 6/2010 | |
| DE | 102009011939 | B4 | | 9/2010 | |
| DE | 102009058551 | B4 | | 9/2011 | |
| DE | 102010009427 | B4 | | 9/2011 | |
| DE | 102014108469 | A1 | | 12/2015 | |
| DE | 102015121771 | A1 | | 1/2017 | |
| DE | 102017002190 | A1 | | 9/2018 | |
| EP | 2018509 | B1 | | 1/2009 | |
| GB | 194722 | A | * | 11/1923 | ..... F41A 3/36 |

* cited by examiner

WEAPON SYSTEM AND BREECHBLOCK

This nonprovisional application is a continuation of International Application No. PCT/EP2020/069278, which was filed on Jul. 8, 2020, and which claims priority to German Patent Application No. 10 2019 120 183.7, which was filed in Germany on Jul. 25, 2019, and which are both herein incorporated by reference.

BACKGROUND OF THE INVENTION

Field of the Invention

The present invention relates to a weapon system and to a breechblock. The invention deals specifically with the possibility of unlocking a breechblock of an in particular externally driven automatic weapon or automatic canon as a weapon system and removing a cartridge case from a weapon barrel.

Description of the Background Art

Independently operated or externally driven automatic cannons are known. In weapon systems of this kind, a cartridge is placed in front of a breechblock and, with the aid of the breechblock movement, the cartridge is brought into a gun barrel or a cartridge chamber of the gun barrel. The breechblock movement includes dwell times during which the breechblock must not be moved. The locking between the breechblock and the weapon barrel takes place in this case via known breechblock systems, such as a block lock, sliding block, rotary lug breech, etc.

A rotary lug breech and a weapon with a rotary lug breech are known from DE 10 2010 009 427 B4, which corresponds to US 2013/0074390. The rotary lug breech has a breechblock carrier and a breechblock head with multiple locking lugs located therein. The rotary lug breech is designed such that the unlocking, in which the cartridge case is released from a cartridge chamber of the weapon barrel, is not controlled exclusively via the relative movement between the breechblock head and breechblock carrier. For this purpose, a cam track section is formed in the locking piece, which cooperates with a correspondingly designed control section in the breechblock head. During unlocking, the rotary movement of the breechblock head is converted into a screwing movement relative to the receiver.

This screwing movement takes the breechblock head out of the locking head in a screwing manner. The same cam tracks and cam track sections also take over the locking of the breechblock.

DE 10 2009 058 551 B4 discloses a further rotary breechblock. A rotary locking cylinder is held in the unlocked position on the breechblock carrier by a groove-spring-like toothing of a connecting link. A guide shell of the breechblock carrier can be reduced thereby to such an extent that it only secures the rotary locking cylinder against tipping out of the functional axis.

A breechblock system for an externally driven and/or independently operated weapon with a block lock can be found in DE 10 2009 011 939 B4. During the recoil of the recoiling mass of the weapon, the block lock is controlled to unlock via cam tracks on the breechblock carrier and during the weapon recoil it is activated again to lock.

A functional control, in particular for the linear loading of ammunition into a weapon barrel, is known from EP 2 018 509 B1. The externally driven weapon comprises a locking ring, which has lugs and is preferably located on the weapon barrel, overlapping it, as well as lugs on a breechblock head. When the breechblock head is at the weapon barrel, the protruding locking ring is rotated, as a result of which the lugs of the locking ring are brought behind the lugs of the breechblock head and the breechblock is locked. The locking ring is turned by means of a pin guided in a cam track. The unlocking occurs by reversing the movement of the pin in the cam track. The dwell times necessary for the weapon are realized here via the control link and the drive link acting together.

DE 10 2017 002 190 A1, which corresponds to US 2018/0259275, discloses a lockable and unlockable self-loading handgun with a breechblock carrier that can be moved back and forth with a control guide in which a feed regulator pin that is rigidly connected to a breechblock head engages. The releasing control edge of the control guide is essentially composed of two straight edge sections transitioning into one another with different inclinations and an curved third edge section adjacent thereto with an even greater inclination. A locking control edge of the control guide is essentially composed of two edge sections which run parallel to the straight edge sections of the releasing cam.

A breechblock with a striking mechanism and a firing pin safety is known from DE 10 2014 108 469 A1. The breechblock carrier has a locking track for locking the breechblock head to the weapon barrel of the weapon, in which track a locking pin is guided, which initiates and effects the locking of the breechblock head by turning the breechblock head in the breechblock carrier.

In the case of an externally driven weapon in particular, at the time the shot is fired, the breechblock is stationary, i.e., in the locked state, whereas the drive or the breechblock drive can continue to run separately from the breechblock. See, for example, DE 10 2015 121 771 A1, which corresponds to US 2018/0231344, which is incorporated herein by reference, and see DE 10 2008 060 217 A1, which corresponds to US 2012/0132062, which is incorporated herein by reference. In its rear position in the weapon system, the so-called loading position, the breechblock drive also continues to run whereas the breechblock itself is stationary in the weapon system. The breechblock is moved into the loading position and back into the firing position via the drive for weapon functioning after unlocking of the breechblock from the weapon barrel.

Such systems, in particular externally driven systems, however, have the problem that great forces act on the breechblock drive when the breechblock is unlocked and the empty cartridge case is removed. Especially in the case of a chain drive as a breechblock drive, large forces act on the chain, wherein the extraction forces must then be applied by the chain.

SUMMARY OF THE INVENTION

It is therefore an object of the present invention to work around this problem.

In an exemplary embodiment, the invention is based on the idea of minimizing the forces acting on a weapon drive or breechblock drive (drive) when the breechblock is unlocked and the cartridge case is removed. In this way, the forces acting on the breechblock drive are reduced or even eliminated, in particular in the case of an external drive (e.g., a chain), when the breechblock is unlocked and the cartridge case is removed.

According to the invention, these tasks of the drive are transferred to the breechblock and the weapon barrel. The breechblock and weapon barrel take over the unlocking and removal of a cartridge case themselves, independently of the drive.

In implementing the idea, the recoil of the weapon (weapon recoil) after the shot is used to unlock the breechblock of the weapon barrel and to remove the cartridge case. In other words, the unlocking of the breechblock and removal of a cartridge case are realized using the recoil and thus the recoiling masses of a weapon.

As is well known, a recoil is initiated when a shot is fired, wherein the recoiling masses of the weapon, such as the weapon barrel and breechblock, are accelerated opposite to the firing direction. At the end of the recoil, part of the recoil energy is stored, for example, in the recoil springs of a recoil mechanism or the like. With this energy the recoiling masses are moved forward again, when these are in the advancing position. With this basic idea, a new approach is created to circumvent deficiencies and problems, especially of an external drive.

In the present case, it is now provided that the actual unlocking of the breechblock and the removal of the cartridge case are carried out during the forward motion of the recoiling mass after the recoil. The unlocking of the breechblock and the removal of the cartridge case thus take place according to the invention in the forward motion or the advancement of the recoiling masses.

When the weapon or weapon system is fired, the breechblock is locked to the weapon barrel. This locking takes place via the chamber sleeve, which in practice is connected to the weapon barrel and, if necessary, to a recoil damper.

An automatic weapon with fire control is known from DE 37 12 905 A1, which is incorporated herein by reference. The breechblock includes an upper breechblock part and a slide, which are each arranged separately, longitudinally displaceable, in the weapon housing and can be coupled to one another in a positively locking manner via connecting means. In the event of a cartridge malfunction, the uncoupled upper breechblock part remains in the locking position, while all other weapon functions or movements are not braked but continue to run. In this regard, a gas-pressure-controlled decoupling of the upper breechblock part from the slide is provided.

The breechblock of the invention is disconnected from the drive at the time of weapon recoil, which occurs after firing. The breechblock preferably comprises at least one breechblock carrier and a breechblock head carried by said carrier.

The separation of the breechblock carrier from the drive and the connection of the breechblock carrier to the drive can be implemented by coupling and uncoupling by means of additional means. During firing and cartridge insertion, i.e., during the breechblock dwell times, the breechblock carrier is stationary in the weapon system when the drive is disengaged. At the end of the forward or reverse movement of the breechblock carrier in the weapon functioning, the drive disengages automatically for this purpose.

A control shaft, for example, can be provided as a means for engaging and disengaging; it actuates a first slide (means) to couple the breechblock carrier to the drive or a second slide (means) to separate this breechblock carrier from the drive. Two further slides are used to lock the breechblock head during the weapon recoil or during the weapon functioning.

In the exemplary embodiment, parts necessary for the functions of unlocking and removal are integrated into the breechblock in order to be able to adapt it to the functions. It can thus be provided to structurally integrate the control shaft into the breechblock carrier. The slides can also be structurally integrated into the breechblock carrier. As a result, only a small installation space is required for the structural implementation of the idea, and the drive in particular is miniaturized.

Once a shot has been fired and the recoil has set in, the breechblock head locked to the barrel, together with the breechblock carrier and barrel, travels back as part of the recoiling masses. After reversal of the weapon recoil, i.e., during the forward motion of the recoiling masses, the breechblock carrier is held in place as part of the breechblock. For this purpose, means are provided that hold the breechblock carrier and release the breechblock head relative to the breechblock carrier (slides). As a result, the breechblock head locked to the weapon barrel can be pulled further forwards with the weapon barrel during the forward motion.

At a predetermined further point in time, the breechblock head is also held in place by further means and the locking between the breechblock head and the chamber sleeve of the weapon barrel is released until the "unlocked" state is reached and the breechblock is unlocked.

Holding the breechblock head in place and releasing it from the weapon barrel can be implemented in the simplest manner by means such as a cam track in the breechblock carrier and a control pin on the breechblock head. For this purpose, the control pin of the breechblock head is guided along the cam track, causing the breechblock head to rotate in the breechblock carrier. With this rotating movement, the breechblock head is released from the weapon barrel. The breechblock head itself is held in place during this phase. In a simplest variant, the holding of the breechblock head in place can be realized, for example, with the front end of the cam track, as seen in the firing direction.

By unlocking the breechblock head from the weapon barrel and connecting the breechblock head to the breechblock carrier, the weapon barrel can now continue to move further forward without the breechblock head until it is in the starting position.

The cartridge case can be at least partially removed from the weapon barrel by the breechblock head, which is stationary in this phase, with the aid of an extractor groove on the breechblock head.

The breechblock, like the drive, can be accommodated in a housing. In this regard, this can be part of a weapon housing. Alternatively, the housing can be designed such that it forms a module. As a result, the breechblock and the drive can be removed from the weapon housing in a simple manner. Modular designs of this kind are often preferred.

Preferably, two guides are introduced particularly over the entire length of the housing. These can be guided in bores in the breechblock carrier. The preferably two guides are used to enable free movement towards the drive for the expected recoil of the weapon when the breechblock is locked.

For the conveying of the breechblock in connection with weapon functioning, the breechblock carrier and the drive are now mechanically connected to one another again after the weapon barrel has been unlocked. Within the scope of weapon functioning, the breechblock head and breechblock carrier are guided by the drive into the rear position within the weapon, in which a next cartridge can be placed in front of the breechblock or the breechblock head. During this second dwell time of the breechblock, it is likewise functionally separated from the breechblock drive.

After a new cartridge has been supplied to the breechblock, the drive is again mechanically connected to or engaged with the breechblock carrier. The breechblock carrier with the breechblock head guides the cartridges into the cartridge chamber of the weapon or the weapon barrel. The breechblock, specifically the breechblock head, is locked to the weapon barrel. A firing pin is only cocked during the locking process.

When the breechblock drive is disengaged, the shot or the weapon recoil is waited for. The cycle starts again with the onset of the recoil.

A weapon system with a breechblock is proposed, wherein the breechblock can be mechanically connected to a drive of the weapon system. The weapon system has means which are designed such that a mechanical separation takes place between the breechblock and the breechblock drive during the recoil of the recoiling masses of the weapon system. During the forward motion of the recoiling masses, the mechanical connection between the breechblock drive and the breechblock is re-formed.

In order to achieve a reduction or even an elimination of the forces acting on the drive when unlocking the breechblock and removing a cartridge case, it is provided that the actual unlocking of the breechblock and the removal of the cartridge case are carried out during the forward motion of the recoiling mass after the recoil. When the breechblock is locked, the breechblock head and breechblock carrier are locked against each other, but freely movable on guides towards the breechblock drive for the expected weapon recoil.

A breechblock is proposed, wherein the breechblock is formed at least by a breechblock carrier and a breechblock head. In this regard, the breechblock carrier carries the breechblock head. The breechblock head has a locking groove. A means for releasing the breechblock head relative to the breechblock carrier is integrated in the locking groove.

The breechblock carrier additionally has a cam track in which a control pin located on the breechblock head can be guided.

However, the use of the breechblock of the invention in independently operated or hybrid-operated weapon systems is not ruled out.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
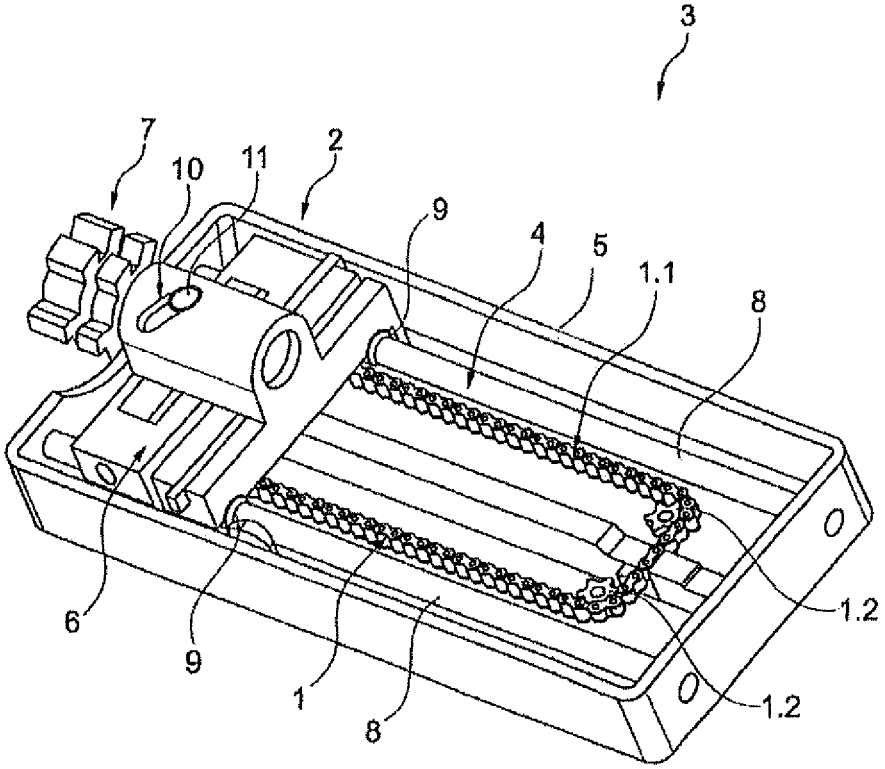
FIG. 1 shows a schematic diagram of a breechblock drive.

In FIG. 1, a drive 1 for a breechblock 2 of a weapon system 3 is shown schematically.

Drive 1 is, for example, an external drive which, in this embodiment, is formed of a chain 1.1 and a motor. Chain 1.1 is in turn guided as a round guide 4 around four sprockets 1.2 within a housing 5. Drive 1 has at least two drive cams 17.

Dwell times of a breechblock 2 to be conveyed by breechblock drive 1 are defined in the front area, as seen in the firing direction, i.e., between the two front sprockets 1.2, as well as in the rear area, between the two rear sprockets 1.2. The length of chain 1.1 between front sprockets 1.2 and rear sprockets 1.2 is determined by the caliber of weapon system 3. In these sections of chain 1.1, breechblock 2 of weapon system 3 is taken from a front to a rear position or from a rear to a front position within the scope of weapon functioning. Drive 1 is thus responsible for the general weapon functioning.

In the present exemplary embodiment, breechblock 2 is formed by a breechblock carrier 6 and by a breechblock head 7. Breechblock head 7 is carried by breechblock carrier 6. Breechblock head 7 comprises, in a known manner, an extractor groove 25 which is used to remove a cartridge case. Drive 1 can be mechanically coupled to breechblock carrier 6.

Breechblock 2 can be locked to and unlocked from a weapon barrel via its breechblock head 7. The locking is realized by a chamber sleeve, which in practice is connected to the weapon barrel and usually to a recoil damper.

Drive 1 is accommodated in a housing 5. Housing 5 can be part of a weapon housing or can be an independent housing of drive 1. The structural variant has the advantage that housing 5 together with drive 1 forms a drive module. As a result, the drive module can be interchangeably attached to the weapon housing as a modular unit.

Two guides or round rods 8 are introduced preferably over the entire length of housing 5. These are guided in bores 9 of breechblock carrier 6. Guides 8 are used to enable a free movement towards drive 1 for the expected weapon recoil when breechblock 2 is locked. Round rods 8 can additionally be used for support and stabilization during the conveying of breechblock 2 within the weapon functioning.

Breechblock carrier 6 has a cam track 10 in which a control pin 11 of breechblock head 7 is guided.

Figure 2:
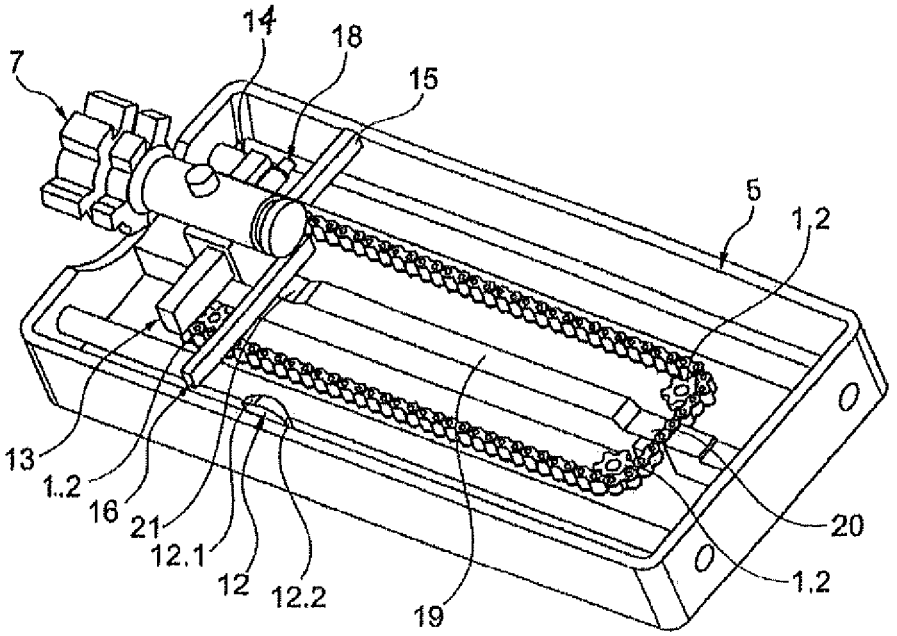
FIG. 2 shows a schematic diagram without the breechblock carrier from FIG. 1.

A control cam 12 is integrated on the side of housing 5 in the path of the weapon recoil. FIG. 2 shows some details from FIG. 1 in more detail. For this purpose, breechblock carrier 6. As can be clearly seen, four slides 13, 14, 15, 16 are provided which are structurally incorporated in breechblock carrier 6. Slides 13, 14, which can be locked against one another and are controlled in the area of a drive cam 17 of chain 1.1, bring about the forward and reverse movement of breechblock 2 during weapon functioning. Drive 1 disengages automatically at the end of the forward or reverse movement of breechblock carrier 6. For this purpose, a control shaft 18 is provided, which is also structurally integrated in breechblock carrier 6. Control shaft 18 operates slide 13, in order to couple breechblock carrier 6 to drive 1, or slide 14 in order to separate breechblock carrier from drive 1, such that slides 13 and 14 form a mechanical separator.

Housing 5 preferably has a central elevation 19 which is run longitudinally within housing 5. Elevation 19 comprises detent points 20, 21 which define the stopping at the rear and at the front for breechblock 2.

Figure 3:
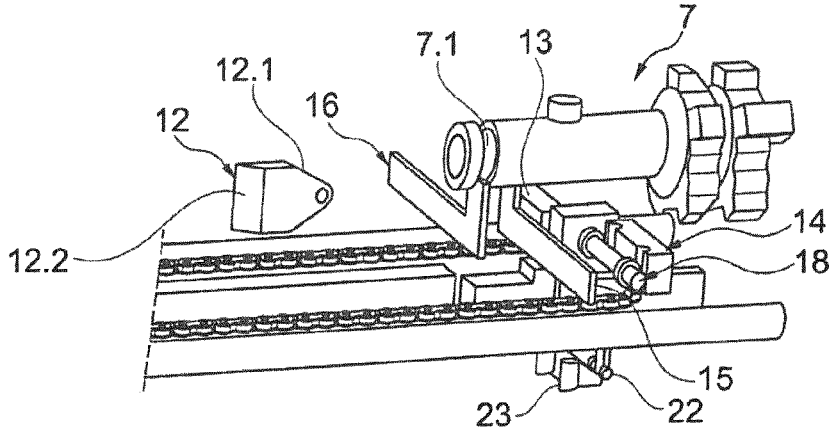
FIG. 3 shows a perspective diagram of components from FIG. 2.

FIG. 3 shows some components from FIG. 2 in more detail. Control cam 12 and slides 13-16 can be clearly seen. Control cam 12 interacts with slide 16 during the weapon recoil. Control cam 12 has a front slope 12.1 and a rear ramp 12.2.

Control shaft 18 for its part interacts with a control plunger 22 which is disposed below housing 5 and which is actuated by a control flap 23 mounted below housing 5.

Figure 4:
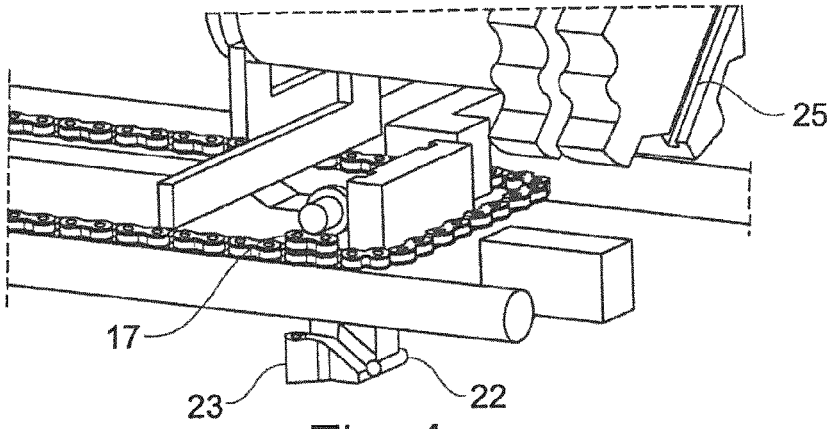
FIG. 4 shows a perspective diagram from the front of the components from FIG. 3.

FIG. 4 shows the components from FIG. 3 in a front perspective view.

Figure 5:
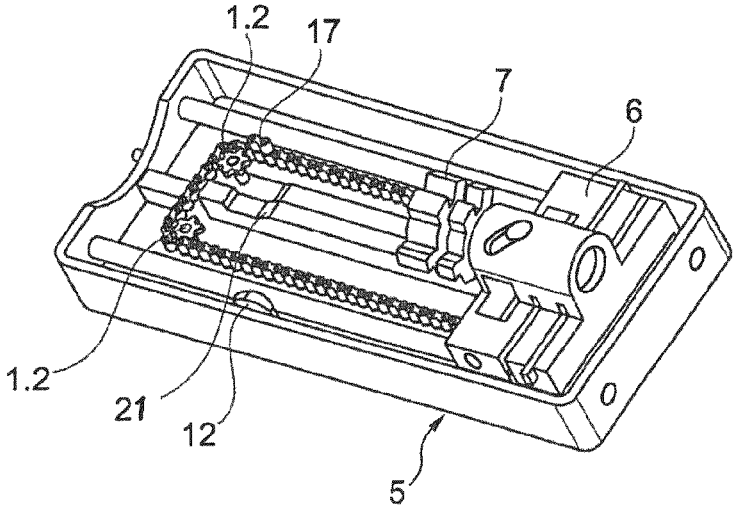
FIG. 5 shows a diagram of the breechblock in the loading position.

FIG. 5 shows breechblock carrier 6 with breechblock head 7, wherein breechblock 2 is opened and is in its loading position (rear position).

The function will be described in more detail with the use of the figures:

During firing, breechblock 2 is separated from drive 1 and disengaged from it. With the weapon recoil, a weapon barrel and breechblock 2, i.e., breechblock carrier 6 and breechblock head 7, are accelerated opposite to the firing direction.

During the recoil of the recoiling masses, slide 16 passes over control cam 12 and pushes it away downwards. After the reversal point of the weapon recoil during the forward motion of the recoiling masses, slide 16 is guided along ramp 12.2 and thereby pressed out of a locking groove 7.1 of breechblock head 7. Locking groove 7.1 is preferably provided at the rear end of breechblock head 7. Breechblock head 7 is released. Breechblock carrier 6, in contrast, is held in place. Breechblock head 7 with the weapon barrel, the chamber sleeve, and, if applicable, the recoil damper, if present, is pulled further forward in the forward motion. At the same time, breechblock head 7 is caused to rotate along cam track 10 until the "unlocked" state is reached. The chamber casing and the weapon barrel move further forward without breechblock head 7 until both are in the starting position (end position).

With the unlocking, a cartridge case is also pulled out of the weapon barrel, at least to some extent. This is done via extractor groove 25 on breechblock head 7, which engages in a groove in the cartridge bottom of the cartridge case.

During the forward motion of the recoiling masses, control plunger 22 is additionally pushed upwards via the control flap or control ramp 23. Slide 14 located above control plunger 22 is pushed upwards. Slide 13 is controlled downward via control shaft 18.

A drive cam 17 of drive 1, which is decoupled from breechblock carrier 6 at this point in time and continues to run in the weapon functioning, runs into slide 13 which is controlled downwards. Drive 1 is now connected to breechblock carrier 6 via slide 13 for the actual weapon functioning.

Breechblock carrier 6 and breechblock head 7 are then moved backwards into the "open position" by coupled drive 1 within weapon system 3 until the position for presenting the next cartridge is reached. In this position, breechblock carrier 6 stands still and is disengaged or uncoupled from breechblock drive 1.

When the cartridge is inserted, breechblock carrier 6 is held in place in housing 5 (5'). This retention is supported by the rear detent point 20. Breechblock head 7 is locked in the "open position" by slide 15 during weapon functioning.

If there is a new cartridge in front of breechblock 2, breechblock carrier 6 is connected to drive 1 again. For this purpose, slide 14 is controlled downwards, which is possible by a similar construction at the rear end of housing 5, similar to 18, 22, 23.

Breechblock carrier 6 with breechblock head 7 is moved into the front position via drive 1. In so doing, they transport the cartridge into a cartridge chamber in the gun barrel. In the front position, breechblock 2 is locked to the weapon barrel or the chamber case.

When breechblock 2 is locked, the chamber sleeve, breechblock head 7, and breechblock carrier 6 are locked against one another by slide 16, but are freely movable towards drive 1 for the expected weapon recoil on round guides 8.

In addition, a firing pin is cocked during the locking process.

When drive 1 is disengaged, the shot is fired or the weapon recoil is waited for. In this regard, weapon system 3 can be operated both selectively as a single shot and in continuous fire.

The cycle starts again with the onset of the weapon recoil.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon system comprising:

a drive;

a breechblock mechanically connected to the drive of the weapon system; and a mechanical separator designed such that a mechanical separation occurs between the breechblock and the drive with a recoil of the breechblock and, with a forward motion of the breechblock, a mechanical connection between the drive and the breechblock is reformed, wherein the breechblock includes a breechblock head and a breechblock carrier, and wherein the mechanical separator comprises two slides that are lockable against one another and are provided in the breechblock carrier.

2. The weapon system according to claim 1, further comprising a housing for receiving the drive and/or the breechblock.

3. The weapon system according to claim 2, wherein at least one guide, which is guided in a longitudinally extending feedthrough of the breechblock carrier, is integrated over an entire length of the housing.

4. The weapon system according to claim 2, wherein a control cam for controlling a slide out of a locking groove in the breechblock head is introduced on a side of the housing.

5. The weapon system according to claim 2, wherein the housing has an elevation which runs longitudinally within the housing, and wherein the elevation comprises detent points.

6. The weapon system according to claim 1, wherein the drive further comprises at least one drive cam.

7. The weapon system according to claim 1, wherein the drive is an externally driven or independently operated drive.

8. A weapon system comprising:

a drive;

a breechblock mechanically connected to the drive of the weapon system; and a mechanical separator designed such that a mechanical separation occurs between the breechblock and the drive with a recoil of the breechblock and, with a forward motion of the breechblock, a mechanical connection between the drive and the breechblock is reformed, wherein the breechblock includes a breechblock head and a breechblock carrier, wherein the mechanical separator comprises two slides that are provided in the breechblock carrier, and wherein the two slides are actuated via a control shaft for coupling the breechblock carrier to the drive and separating the breechblock carrier from the drive.

9. The weapon system according to claim 8, wherein the two slides are controllable slides.

10. The weapon system according to claim 8, wherein the two slides are structurally disposed in the breechblock carrier.

11. The weapon system according to claim 8, wherein the control shaft is structurally integrated in the breechblock carrier.

12. A breechblock of a weapon system, the breechblock comprising:

a breechblock carrier; and a breechblock head, wherein the breechblock carrier carries the breechblock head, wherein the breechblock head has a locking groove, a slide integrated in the locking groove, wherein the slide is adapted to be pressed out of the locking groove of the breechblock head to release the breechblock head from the breechblock carrier, and wherein the slide is a controllable slide, and wherein the breechblock head has an extractor groove.

13. The breechblock according to claim 12, wherein the breechblock carrier has at least one feedthrough running in a longitudinal direction.

14. The breechblock according to claim 12, wherein the breechblock carrier has a cam track, and wherein a control pin of the breechblock head is guided in the cam track.

15. The breechblock according to claim 12, wherein the breechblock is received in a housing.

16. The breechblock according to claim 12, wherein two additional slides are provided in the breechblock carrier, and wherein the two additional slides are actuated via a control shaft for coupling the breechblock carrier to a drive and separating the breechblock carrier from the drive.

17. The breechblock according to claim 16, wherein the drive comprises at least one drive cam.

* * * * *